US012227824B2

(12) United States Patent
Lee et al.

(10) Patent No.: US 12,227,824 B2
(45) Date of Patent: Feb. 18, 2025

(54) STEEL WIRE ROD ENABLING OMISSION OF SOFTENING HEAT TREATMENT AND METHOD OF MANUFACTURING SAME

(71) Applicant: POSCO, Pohang-si (KR)

(72) Inventors: Jae-Seung Lee, Pohang-si (KR); Yo-Sep Yang, Pohang-si (KR); In-Gyu Park, Pohang-si (KR); Han-Hwi Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 853 days.

(21) Appl. No.: 17/288,998

(22) PCT Filed: Oct. 18, 2019

(86) PCT No.: PCT/KR2019/013702
§ 371 (c)(1),
(2) Date: Apr. 27, 2021

(87) PCT Pub. No.: WO2020/091277
PCT Pub. Date: May 7, 2020

(65) Prior Publication Data

US 2021/0404039 A1 Dec. 30, 2021

(30) Foreign Application Priority Data

Oct. 31, 2018 (KR) ..... 10-2018-0132073

(51) Int. Cl.
*C22C 38/22* (2006.01)
*C21D 8/00* (2006.01)
(Continued)

(52) U.S. Cl.
CPC ..... *C22C 38/22* (2013.01); *C21D 8/065* (2013.01); *C21D 9/525* (2013.01); *C22C 38/02* (2013.01);
(Continued)

(58) Field of Classification Search
CPC ..... C22C 38/22; C22C 38/02; C22C 38/04; C22C 38/06; C22C 38/001; C22C 38/38;
(Continued)

(56) References Cited

U.S. PATENT DOCUMENTS

2003/0015264 A1 1/2003 Kanisawa et al.
2015/0041029 A1 2/2015 Yamashita et al.
2022/0033920 A1 2/2022 Lee et al.

FOREIGN PATENT DOCUMENTS

CN 106636883 A 5/2017
EP 3342892 A1 7/2018
(Continued)

OTHER PUBLICATIONS

Japanese Office Action dated Jul. 5, 2022 issued in Japanese Patent Application No. 2021-523443.
(Continued)

*Primary Examiner* — Anthony M Liang
*Assistant Examiner* — Danny N Kang
(74) *Attorney, Agent, or Firm* — Morgan, Lewis & Bockius LLP

(57) ABSTRACT

The present disclosure relates to a steel wire rod enabling the omission of softening heat treatment and a method of manufacturing same. An embodiment of the present disclosure provides a steel wire rod enabling the omission of softening heat treatment and a method of manufacturing same, the steel wire rod comprising, in weight %, 0.2-0.45% of C, 0.02-0.4% of Si, 0.3-1.5% of Mn, 0.01-1.5% of Cr, 0.02-0.05% of Al, 0.01-0.5% of Mo, 0.01% or less of N, and the balance Fe and other unavoidable impurities, wherein the microstructure of the steel wire rod is a composite structure of proeutectoid ferrite+perlite as a main phase; the steel wire rod contains 10 area % or less (including 0%) of
(Continued)

at least one of bainite or martensite; and the average colony size of the perlite is 5 μm or less.

7 Claims, 3 Drawing Sheets

(51) Int. Cl.

| | |
|---|---|
| ***C21D 8/06*** | (2006.01) |
| ***C21D 9/52*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/04* (2013.01); *C22C 38/06* (2013.01); *C21D 2211/005* (2013.01); *C21D 2211/009* (2013.01)

(58) Field of Classification Search
CPC .. C21D 8/065; C21D 9/525; C21D 2211/005; C21D 2211/009; C21D 1/32; C21D 6/002; C21D 9/5732; C21D 9/64; C21D 9/573; C21D 8/0226; C21D 8/0263; C21D 2211/003
See application file for complete search history.

(56) References Cited

FOREIGN PATENT DOCUMENTS

| | | | |
|---|---|---|---|
| JP | S59-136421 | A | 8/1984 |
| JP | S59-136422 | A | 8/1984 |
| JP | J06-173027 | A | 6/1994 |
| JP | H11-236644 | A | 8/1999 |
| JP | 2000-119809 | A | 4/2000 |
| JP | 2000-336456 | A | 12/2000 |
| JP | 2001-089830 | A | 4/2001 |
| JP | 2002-069566 | A | 3/2002 |
| JP | 2006-225701 | A | 8/2006 |
| JP | 2011-246769 | A | 12/2011 |
| KR | 10-0535769 | A | 12/2005 |
| KR | 10-2011-0033534 | A | 3/2011 |
| KR | 10-2014-0139020 | A | 12/2014 |
| KR | 10-2018-0011427 | A | 2/2018 |
| KR | 10-2018-0072965 | A | 7/2018 |
| KR | 10-2020-0075305 | A | 6/2020 |

OTHER PUBLICATIONS

Extended European Search Report dated Dec. 21, 2021 issued in European Patent Application No. 19878062.9.
International Search Report dated Jan. 21, 2020 issued in International Patent Application No. PCT/KR2019/013702 (with English translation).

【Fig. 1】
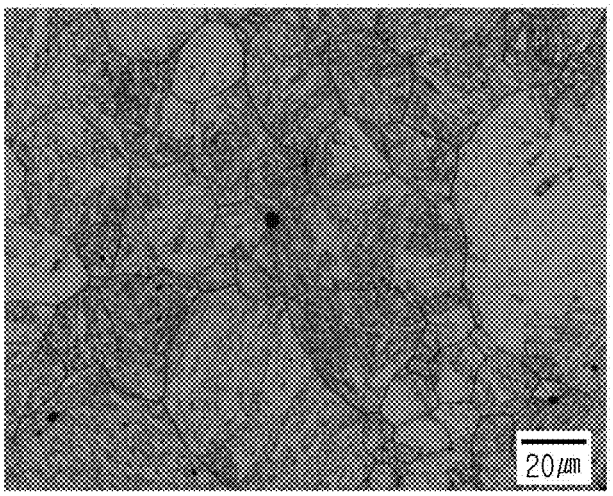
【Fig. 2】
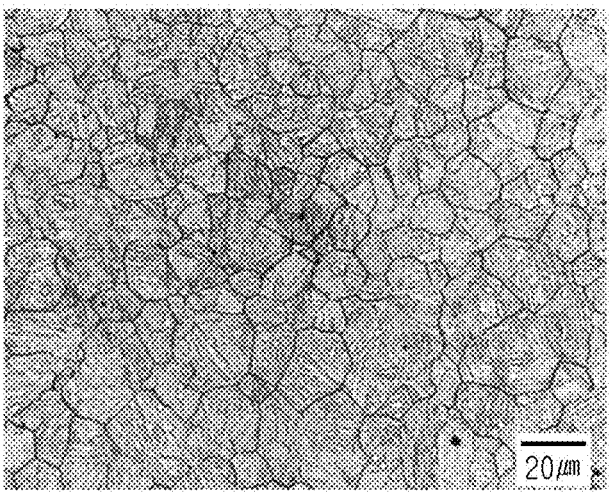

【Fig. 3】
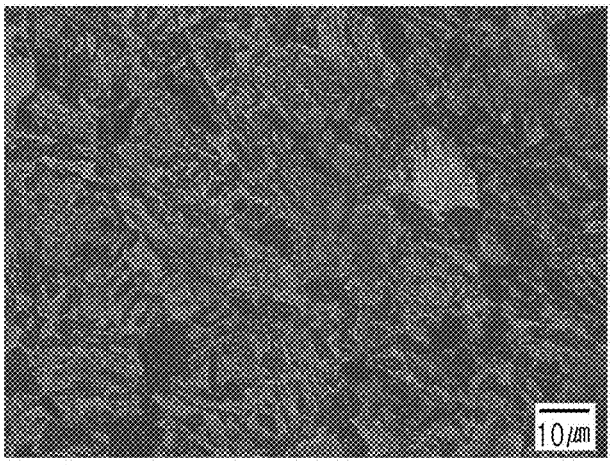
【Fig. 4】
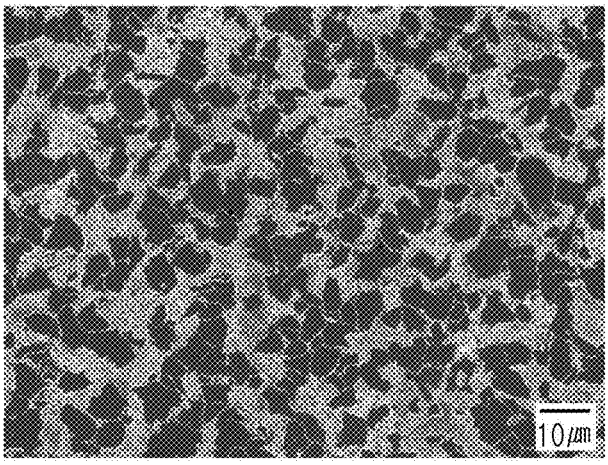

【Fig. 5】
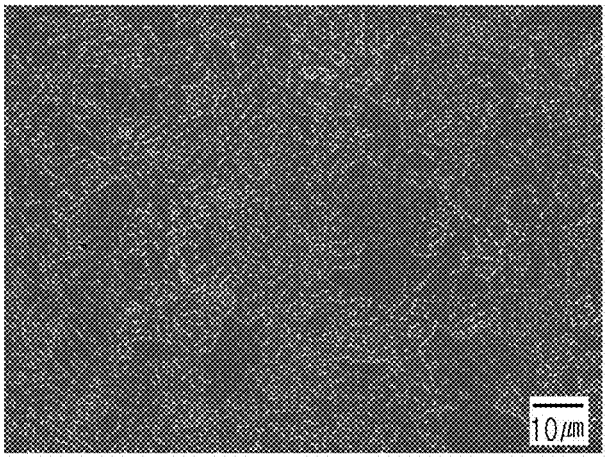
【Fig. 6】
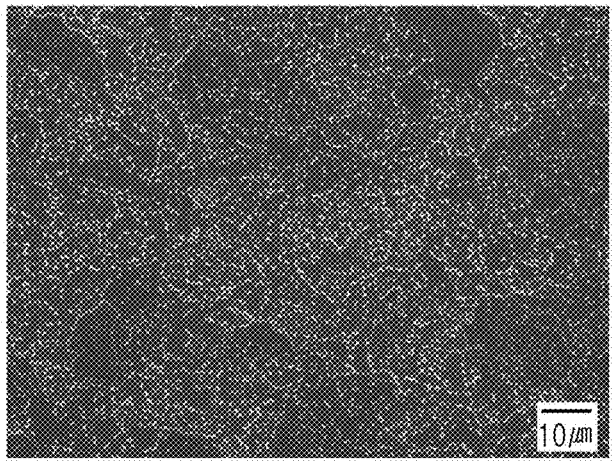

STEEL WIRE ROD ENABLING OMISSION OF SOFTENING HEAT TREATMENT AND METHOD OF MANUFACTURING SAME

CROSS-REFERENCE OF RELATED APPLICATIONS

This application is the U.S. National Phase under 35 U.S.C. § 371 of International Patent Application No. PCT/KR2019/013702, filed on Oct. 18, 2019, which in turn claims the benefit of Korean Application No. 10-2018-0132073, filed on Oct. 31, 2018, the entire disclosures of which applications are incorporated by reference herein.

TECHNICAL FIELD

The present disclosure relates to a steel wire rod enabling the omission of a softening heat treatment and a method of manufacturing the same, and more particularly, a steel wire rod used for a mechanical structure which may be applicable to vehicles, construction components, and the like, and a method of manufacturing the same.

BACKGROUND ART

Generally, for softening of a material for cold processing, a lengthy heat treatment of 10 to 20 hours or more at a high temperature of 600-800° C. may be required, and many techniques have been developed to shorten or omit the treatment.

Reference 1 may be a representative technique. The purpose of the above technique is to, by refining grains by controlling a ferrite grain size to be 11 or more and controlling 3-15% of a hard plate-shaped cementite phase in a pearlite structure to have a segmented form, omit a softening heat treatment subsequently performed. However, to manufacture such a material, a cooling rate in cooling after hot-rolling may need to be extremely low, 0.02-0.3° C./s. The slow cooling rate may be accompanied by a decrease in productivity, and a separate slow cooling facility and a slow cooling yard may be necessary depending on an environment.

PRIOR ART DOCUMENT (Reference 1) Japanese Laid-Open Patent Publication No. 2000-336456

DISCLOSURE

Technical Problem

One aspect of the present disclosure is to provide a steel wire rod enabling the omission of a softening heat treatment in cold processing of vehicles, construction components, and the like, and a method of manufacturing the same.

Technical Solution

An embodiment of the present disclosure provides a steel wire rod enabling omission of softening heat treatment, the steel wire rod including, by weight %, 0.2-0.45% of C, 0.02-0.4% of Si, 0.3-1.5% of Mn, 0.01-1.5% of Cr, 0.02-0.05% of Al, 0.01-0.5% of Mo, 0.01% or less of N, and a balance Fe and other inevitable impurities, wherein a microstructure has a main phase of a composite structure of proeutectoid ferrite+perlite, and includes 10 area % or less (including 0%) of one or more of bainite or martensite, and wherein an average colony size of pearlite is 5 μm or less.

Another embodiment of the present disclosure provides a method of manufacturing a steel wire rod enabling omission of softening heat treatment, the method including heating a billet including, by weight %, 0.2-0.45% of C, 0.02-0.4% of Si, 0.3-1.5% of Mn, 0.01-1.5% of Cr, 0.02-0.05% of Al, 0.01-0.5% of Mo, 0.01% or less of N, and a balance Fe and other inevitable impurities, at 950-1050° C.; obtaining a steel wire rod by finishing hot-rolling the heated billet in a deformation amount of 0.3-2.0 at 730° C.-Ae3; and cooling the steel wire rod to a temperature of Ae1 or less at 2° C./sec or less.

Advantageous Effects

According to one aspect of the present disclosure, a steel wire rod enabling the omission of a softening heat treatment in cold processing of vehicles, construction components, and the like, and a method of manufacturing same may be provided

BRIEF DESCRIPTION OF DRAWINGS

FIG. 1 is an image of a microstructure before finishing hot-rolling in comparative example 1, obtained using an optical microscope;

FIG. 2 is an image of a microstructure before finishing hot-rolling in inventive example 1, obtained using an optical microscope;

FIG. 3 is an image of a microstructure after rolling and cooling in comparative example 1, obtained using an SEM;

FIG. 4 is an image of a microstructure after rolling and cooling in inventive example 1, obtained using an SEM;

FIG. 5 is an image of a microstructure after a spheroidizing heat treatment in comparative example 1, obtained using an SEM; and FIG. 6 is an image of a microstructure after a spheroidizing heat treatment in inventive example 1, obtained using an SEM.

BEST MODE FOR INVENTION

In the description below, a steel wire rod having excellent spheroidizing heat treatment properties according to an embodiment of the present disclosure will be described. First, an alloy composition of the present disclosure will be described.

The content of the alloy composition described below is represented by weight % unless otherwise indicated.

C: 0.2-0.45%

C may be added to secure a certain level of strength. When the content of C exceeds 0.45%, the entire structure may be formed of pearlite, such that it may be difficult to secure a ferrite structure, the purpose of the present disclosure, and hardenability may excessively increase such that it may be highly likely that a hard low-temperature transformation structure may be formed. When the content is less than 0.2%, strength of a base material may degrade such that it may be difficult to secure sufficient strength after hardening and tempering heat treatment performed after softening heat treatment and a forging process. Therefore, preferably, the content of C may have a range of 0.2-0.45%. A lower limit of the C content may be more preferably 0.22%, even more preferably 0.24%, and most preferably 0.26%. An upper limit of the C content may be more preferably 0.43%, even more preferably 0.41%, and most preferably 0.39%.

Si: 0.02-0.4%

Si may be a representative substitutional element and may be added to secure a certain level of strength. When Si is less than 0.02%, it may be difficult to secure strength of steel and sufficient hardenability, and when C exceeds 0.4%, cold forging properties may be deteriorated during forging after softening heat treatment, which may be disadvantageous. Therefore, preferably, the Si content may have a range of 0.02-0.4%. A lower limit of the Si content may be more preferably 0.022%, even more preferably 0.24%, and most preferably 0.26%. An upper limit of the Si content may be more preferably 0.038%, even more preferably 0.036%, and most preferably 0.034%.

Mn: 0.3-1.5%

Mn may form a substituted solid solution in a matrix structure, and may lower a temperature Al such that Mn may refine an interlayer spacing of pearlite, and Mn may increase sub-crystal grains in a ferrite structure. When Mn exceeds 1.5%, a harmful effect may occur by structure heterogeneity caused by manganese segregation. When steel is solidified, macrosegregation and microsegregation may be likely to occur depending on a segregation mechanism, and Mn may promote segregation due to a relatively low diffusion coefficient compared to other elements, and improvement of hardenability caused by this may be a main cause of creating a low-temperature structure like martensite in the central region. When the Mn is less than 0.3%, it may be difficult to secure sufficient hardenability to secure a martensite structure after hardening and tempering heat treatment performed after the softening heat treatment and a forging process. Therefore, preferably, the content of Mn may have a range of 0.3-1.5%. A lower limit of the Mn content may be more preferably 0.4%, even more preferably 0.5%, and most preferably 0.6%. An upper limit of the Mn content may be more preferably 1.4%, even more preferably 1.3%, and most preferably 1.20.

Cr: 0.01-1.5%

Similarly to Mn, Cr may be mainly used as an element for enhancing hardenability of steel. When Cr is less than 0.01%, it may be difficult to secure sufficient hardenability to obtain martensite during hardening and tempering heat treatment performed after softening heat treatment and a forging processes, and when Cr exceeds 1.5%, central segregation may be promoted such that it may be highly likely that low-temperature structure may be formed in the steel wire rod. Therefore, preferably, the content of Cr may have a range of 0.01-1.5%. A lower limit of the Cr content may be more preferably 0.1%, even more preferably 0.3%, and most preferably 0.5%. An upper limit of the Cr content may be more preferably 1.4%, even more preferably 1.3%, and most preferably 1.2%.

Al: 0.02-0.05%

Al may have a deoxidation effect, and may precipitate Al-based carbonitride such that austenite grain growth may be inhibited and a fraction of proeutectoid ferrite may be secured close to an equilibrium phase. When Al is less than 0.02%, the deoxidation effect may be not sufficient, and when Al exceeds 0.05%, hard inclusions such as Al $2O_3$ may increase, and in particular, nozzle clogging may occur due to the inclusions during continuous casting. Therefore, preferably, the Al content may have a range of 0.02-0.05%. A lower limit of the Al content may be more preferably 0.022%, even more preferably 0.024%, and most preferably 0.026%. An upper limit of the Al content may be more preferably 0.048%, even more preferably 0.046%, and most preferably 0.044%.

Mo: 0.01-0.5%

Mo may precipitate Mo-based carbonitrides such that Mo may inhibit austenite grain growth, and may contribute to securing a fraction of proeutectoid ferrite close to an equilibrium phase, and Mo may form $Mo_2C$ precipitates during tempering in a hardening and tempering heat treatment performed after a softening heat treatment and forging process, such that Mo may be effective in inhibiting strength degradation (temper softening). When Mo is less than 0.01%, it may be difficult to have a sufficient effect of inhibiting strength degradation, and when Mo exceeds 0.5%, a low-temperature structure may be formed in the steel wire rod, such that additional heat treatment costs for removing the low-temperature structure may be necessary. Therefore, preferably, Mo may have a range of 0.01-0.5%. A lower limit of the Mo content may be more preferably 0.012%, even more preferably 0.013%, and most preferably 0.014. An upper limit of the Mo content may be more preferably 0.49%, even more preferably 0.48%, and most preferably 0.47%.

N: 0.01% or less

N may be one of impurities, and when N exceeds 0.01%, material toughness and ductility may be deteriorated due to solid solute nitrogen not combined as a precipitate. Therefore, preferably, the content of N may have a range of 0.01% or less. The N content may be more preferably 0.019% or less, even more preferably 0.018% or less, and most preferably 0.017% or less.

A remainder of the present disclosure may be iron (Fe). However, in a general manufacturing process, inevitable impurities may be inevitably added from raw materials or an ambient environment, and thus, impurities may not be excluded. A person skilled in the art of a general manufacturing process may be aware of the impurities, and thus, the descriptions of the impurities may not be provided in the present disclosure.

Preferably, a microstructure of the steel wire rod of the present disclosure may be a composite structure of proeutectoid ferrite+pearlite. Simply in terms of spheroidization of steel, bainite steel with fine cementite may be advantageous, but it has been reported that cementite spheroidized from bainite may be extremely fine such that growth thereof may be extremely slow. Thus, a ferrite+pearlite+bainite composite structure may be disadvantageous in terms of structure homogenization. Therefore, in the present disclosure, by controlling the microstructure of the steel wire rod to be a composite structure of proeutectoid ferrite+pearlite, spheroidizing heat treatment properties may improve, and also the structure may be further homogenized. In this case, a fraction of proeutectoid ferrite may preferably be 80% or more of an equilibrium phase, and when the fraction is less than 80% of an equilibrium phase, a relatively hard low-temperature structure may be formed in a large amount such that it may be difficult to effectively secure a spheroidization heat treatment properties. However, in the present disclosure, a low-temperature structure which may inevitably be formed during manufacturing, one or more of bainite or martensite, for example, may be included by 10 area % or less. Thus, a microstructure in the present disclosure may be a composite structure in which a main phase may be ferrite+pearlite, and may include 10 area % or less (including 0%) of one or more of bainite or martensite. Preferably, a fraction of one or more of bainite or martensite may be 5 area % or less. An equilibrium phase of proeutectoid ferrite may refer to a maximum fraction of proeutectoid ferrite which may be included in a stable state on a $Fe_3C$ phase diagram. The equilibrium phase of proeutectoid ferrite may be easily derived by a person skilled in the art in consideration of the C content and the content of the other alloy elements through the $Fe_3C$ phase diagram.

In this case, an average size of a colony of pearlite may be preferably 5 μm or less. By controlling an average size of pearlite colonies to be fine as described above, the effect of segmentation of cementite may improve, such that a spheroidization rate of cementite may increase during spheroidization heat treatment.

Also, preferably, an average grain size of proeutectoid ferrite may be 7 μm or less. As described above, by controlling the average grain size of ferrite to be fine, the size of pearlite colonies may also be refined, and accordingly, a spheroidization rate of cementite may increase during spheroidization heat treatment.

Also, preferably, an average size of a long axis of cementite in the pearlite colony may be 5 μm or less. As described above, by controlling the average size of the long axis of cementite in the pearlite colony to be small, that is, by controlling a cementite aspect ratio to be small, a spheroidization rate of cementite during spheroidization heat treatment may increase.

In the present disclosure, the average size of the pearlite colony, the average grain size of the proeutectoid ferrite, and the average size of the long axis of cementite in the pearlite colony may be of a central portion with reference to a diameter of the steel wire rod, that is, ⅖ point-⅗ point from the surface with reference to the diameter. Generally, since a surface layer of the steel rod wire may receive strong rolling force during rolling, the average size of colonies of pearlite, the average grain size of proeutectoid ferrite, and the average size of the long axis of cementite in the pearlite colony may be fine. However, in the present disclosure, by refining the average colony size of pearlite and the average grain size of ferrite on the surface layer of the steel wire rod and also in the central portion, the rate of spheroidization of cementite may effectively increase during spheroidization heat treatment.

The steel wire rod provided in the present disclosure may have tensile strength of 800 MPa or less. Generally, to manufacture a steel wire rod into a steel wire, a primary softening heat treatment→primary wire drawing→a secondary softening heat treatment→secondary wire drawing may be performed. However, as for the steel wire rod of the present disclosure, processes corresponding to the primary soft softening heat treatment and the primary wire drawing may be omitted through sufficient softening of the material. The softening heat treatment in the present disclosure may include a low-temperature annealing heat treatment performed below an Ae1 phase transformation point, a medium temperature annealing heat treatment performed at around Ae1, and a spheroidizing annealing heat treatment performed above Ae1.

Also, the steel wire rod of the present disclosure may have an average aspect ratio of cementite of 2.5 or less after spheroidizing annealing heat treatment is performed once. Generally, it is widely known that the spheroidizing annealing heat treatment may be effective in spheroidizing of cementite as the number of performing the treatment increases. However, in the present disclosure, cementite may be sufficiently spheroidized by only performing the spheroidizing annealing heat treatment once. As mentioned above, since the surface layer of the steel wire rod receives strong rolling force during rolling, the spheroidization of cementite may also be carried out smoothly. However, in the present disclosure, cementite in the central portion with reference to the diameter of the steel wire rod, in the area of ¼ point-½ point from the surface with reference to the diameter, for example, may be sufficiently spheroidized, such that the average aspect ratio of cementite in the central portion of the steel wire rod may be 2.5 or less. Also, the steel wire rod of the present disclosure may have tensile strength of 540 MPa or less after the spheroidization heat treatment is performed once, and accordingly, cold-rolling or cold-forging processing for manufacturing a final product may be easily performed.

In the description below, a method of manufacturing a steel wire rod having excellent spheroidizing heat treatment properties according to an embodiment of the present disclosure will be described.

First, a billet having the alloy composition described above may be heated at 950-1050° C. When the billet heating temperature is less than 950° C., rollability may decrease, and when the billet heating temperature exceeds 1050° C., rapid cooling may be necessary for rolling, such that it may be difficult to control the cooling and cracks may be created, and accordingly, it may be difficult to ensure good product quality.

The heating time during the heating may be preferably 90 minutes or less. When the heating time exceeds 90 minutes, a depth of a surface decarburization layer may increase, such that the decarburization layer may remain after the rolling is completed.

Thereafter, the heated billet may be finishing hot-rolled at 730° C.-Ae3 in a deformation amount (s) of 0.3-2.0, thereby obtaining a steel wire rod. A rate of rolling the steel wire rod may be extremely high and may belong to a dynamic recrystallization area. Research results up to date have indicated that an austenite grain size may depend only on a deformation rate and a deformation temperature under dynamic recrystallization conditions. Due to characteristics of wire rod rolling, when a wire diameter is determined, the amount of deformation and the deformation rate may be determined, and the austenite grain size may be changed by adjusting the deformation temperature. In the present disclosure, during dynamic recrystallization, grains may be refined using a dynamic deformation organic transformation phenomenon. To secure the microstructure grains to be obtained in the present disclosure using the phenomenon, it may be preferable to control the finishing rolling temperature to be 730° C.-Ae3. When the finish rolling temperature exceeds Ae3, it may be difficult to obtain microstructure grains to be obtained in the present disclosure such that it may be difficult to obtain sufficient spheroidizing heat treatment properties. When the temperature is less than 730° C., equipment load may increase such that equipment lifespan may be rapidly reduced. Also, when the amount of deformation (s) is less than 0.3, reduction amount may be not sufficient, such that it may be difficult to sufficiently refine the microstructure in the central region of the steel rod wire, and spheroidization heat treatment properties of the steel rod wire obtained therefrom may degrade. When the amount exceeds 2.0, equipment lifespan may rapidly degrade due to degradation of productivity and equipment bearing breakage, caused by rolling load.

Before the finish hot-rolling, preferably, the average austenite grain size of the billet may be 5-20 μm. Ferrite may be known to nucleate at an austenite grain boundary and may grow. When austenite grains, a base phase, are fine, ferrite nucleating at grain boundaries may also start to be finely formed, such that, by controlling the average austenite grain size of the billet before the finish hot-rolling as described above, the ferrite grain refinement effect may be obtained. When the austenite grain average size exceeds 20 μm, it may be difficult to obtain a ferrite grain refining effect, and to obtain an average austenite grain size of less than 5 μm, a separate facility to additionally apply a high amount of deformation such as strong reduction may be necessary, which may be disadvantageous.

Thereafter, the steel rod wire may be cooled to 2° C./sec or less to a temperature of Ae1 or less. When a rate of cooling the steel wire rod exceeds 2° C./sec, a low-temperature structure such as bainite may be generated in the fine segregation portion of the steel wire rod. In the fine segregation portion, segregation of twice or more than the average of the steel wire rod may be formed, and accordingly, a low-temperature structure may be generated even at a low cooling rate, which may adversely affect the structure homogenization of the steel. The rate of cooling the steel wire rod may be more preferably 0.5-2° C./sec in terms of refinement of grains of the microstructure.

In the present disclosure, a spheroidizing heat treatment in which the steel wire rod may be heated to Ae1-Ae1+40° C., may be maintained for 10-15 hours, and may be cooled to 660° C. at 20° C./hr or less may be further included after the cooling. When the heating temperature is less than Ae1, there may be a disadvantage in that the spheroidizing heat treatment time may be prolonged, and when the temperature exceeds Ae1+40° C., the spheroidizing carbide seeds may be reduced, such that the spheroidizing heat treatment effect may not be sufficient. When the maintaining time is less than 10 hours, spheroidizing heat treatment may be not sufficiently performed, such that the aspect ratio of cementite may increase, which may be disadvantageous. When the cooling rate exceeds 20° C./hr, there may be a disadvantage in that pearlite may be formed again due to the high cooling rate. As mentioned above, in the present disclosure, even when only the spheroidizing heat treatment is performed without the primary soft softening heat treatment and the primary wire drawing, sufficient spheroidizing heat treatment properties may be secured.

BEST MODE FOR INVENTION

Hereinafter, the present disclosure will be described in more detail through examples. However, it should be noted that the following examples are for illustrative purposes only and are not intended to limit the scope of the present disclosure. The scope of the present disclosure may be determined by matters described in the claims and matters able to be reasonably inferred therefrom.

EMBODIMENT

A billet having an alloy composition as in Table 1 below was prepared, a steel wire rod having a diameter of 9 mm was manufactured using the conditions described in Table 2 below. With respect to the steel wire rod prepared as above, a microstructure, an average grain size of proeutectoid ferrite, an average size of colony of pearlite, an average size of a long axis of cementite in the pearlite colony, and tensile strength were measured, and the results are listed in Table 3 below. Also, spheroidization heat treatment was performed on the steel wire rod once under the conditions as in Table 4 below, an average aspect ratio of cementite and tensile strength were measured, and the results are listed in Table 4 below. In this case, the spheroidizing heat treatment was performed without performing the primary softening treatment and the primary wire drawing process on a sample of the steel wire rod manufactured described above.

The austenite grain average size (AGS) was measured through a cutting crop performed before finishing hot-rolling.

Ae1 and Ae3 displayed values calculated using JmatPro, a commercial program.

As for an average grain size (FGS) of proeutectoid ferrite, the steel rod wire was rolled using a ASTM E112 method, a non-water cooling portion was removed, and 3 arbitrary points in the area of ⅖ point-⅗ point from the diameter of the obtained sample were measured, and an average value thereof was calculated.

As for the average size of colonies of pearlite, 10 arbitrary pearlite colonies were selected from the same point as in the FGS measurement using an ASTM E112 method, a (long axis+short axis)/2 value of each colony was obtained, and an average value of colony sizes was obtained.

As for the average aspect ratio of cementite after the spheroidization heat treatment, 3 fields of view of 2000 times SEM of ¼-½ point was imaged in a direction of a diameter of the steel rod wire, and a long axis/short axis of cementite in the field of view were automatically measured using an image measurement program, and was statistically processed.

TABLE 1

| | Alloy composition (weight %) | | | | | | |
|---|---|---|---|---|---|---|---|
| Classification | C | Si | Mn | Cr | Al | Mo | N |
| Inventive steel 1 | 0.25 | 0.3 | 1.3 | 1 | 0.032 | 0.2 | 0.085 |
| Inventive steel 2 | 0.35 | 0.3 | 1.3 | 0.9 | 0.028 | 0.3 | 0.062 |
| Comparative steel 1 | 0.4 | 0.2 | 1.2 | 1.1 | 0.042 | 0.7 | 0.050 |
| Comparative steel 2 | 0.72 | 0.3 | 0.8 | 0.8 | 0.035 | 0.7 | 0.058 |
| Inventive steel 3 | 0.35 | 0.2 | 0.7 | 1 | 0.031 | 0.2 | 0.068 |
| Inventive steel 4 | 0.4 | 0.25 | 0.8 | 0.9 | 0.036 | 0.15 | 0.071 |
| Inventive steel 5 | 0.35 | 0.3 | 1.2 | 1.1 | 0.034 | 0.2 | 0.069 |
| Inventive steel 6 | 0.35 | 0.18 | 1.2 | 1.15 | 0.035 | 0.3 | 0.072 |
| Inventive steel 7 | 0.3 | 0.15 | 1.4 | 0.8 | 0.028 | 0.3 | 0.080 |

TABLE 2

| Classification | Steel type No. | Heating temperature (° C.) | Heating time (min) | Ae3 (° C.) | Finishing rolling temperature (° C.) | Deformation amount | Ae1 (° C.) | Cooling stop temperature (° C.) | Cooling rate (° C./s) |
|---|---|---|---|---|---|---|---|---|---|
| Comparative example 1 | Inventive steel 1 | 1000 | 90 | 790 | 900 | 0.2 | 715 | 732 | 5 |
| Comparative example 2 | Inventive steel 2 | 1150 | 120 | 775 | 800 | 0.1 | 715 | 721 | 1.5 |

TABLE 2-continued

| Classification | Steel type No. | Heating temperature (° C.) | Heating time (min) | Ae3 (° C.) | Finishing rolling temperature (° C.) | Deformation amount | Ae1 (° C.) | Cooling stop temperature (° C.) | Cooling rate (° C./s) |
|---|---|---|---|---|---|---|---|---|---|
| Comparative example 3 | Comparative steel 1 | 1020 | 90 | 770 | 780 | 0.9 | 720 | 735 | 2 |
| Comparative example 4 | Comparative steel 2 | 1000 | 90 | 745 | 750 | 0.6 | 730 | 740 | 5 |
| Inventive example 1 | Inventive steel 3 | 950 | 90 | 785 | 760 | 1.2 | 735 | 729 | 2 |
| Inventive example 2 | Inventive steel 4 | 1000 | 80 | 775 | 750 | 0.8 | 730 | 715 | 1 |
| Inventive example 3 | Inventive steel 5 | 1020 | 90 | 775 | 730 | 0.6 | 720 | 701 | 1 |
| Inventive example 4 | Inventive steel 6 | 990 | 90 | 770 | 760 | 0.8 | 721 | 691 | 1.5 |
| Inventive example 5 | Inventive steel 7 | 1020 | 90 | 780 | 750 | 1.0 | 704 | 658 | 2 |

TABLE 3

| Classification | Microstructure (area %) | | | | Pearlite colony | Proeutectoid ferrite grain | Cementite long axis average | Tensile |
|---|---|---|---|---|---|---|---|---|
| | Equilibrium phase F | F | P | B + M | average size (μm) | average size (μm) | in pearlite colony (μm) | strength (MPa) |
| Comparative example 1 | 70 | 10 | 10 | 80 | 10 | 10 | 9 | 820 |
| Comparative example 2 | 55 | 14 | 71 | 15 | 13 | 12 | 11 | 850 |
| Comparative example 3 | 45 | 12 | 63 | 25 | 12 | 15 | 10 | 900 |
| Comparative example 4 | 5 | 3 | 50 | 47 | 15 | 8 | 15 | 1030 |
| Inventive example 1 | 45 | 40 | 55 | 5 | 3 | 3 | 3.5 | 770 |
| Inventive example 2 | 41 | 38 | 57 | 5 | 3 | 4 | 3.4 | 740 |
| Inventive example 3 | 46 | 39 | 61 | 0 | 5 | 6 | 4.3 | 720 |
| Inventive example 4 | 47 | 41 | 56 | 3 | 3.2 | 2.8 | 3 | 760 |
| Inventive example 5 | 49 | 40 | 58 | 2 | 4.2 | 4.5 | 4 | 750 |

F: proeutectoid ferrite,
P: pearlite,
B: bainite,
M: martensite

TABLE 4

| Classification | Heating temperature (° C.) | Heating time (Hr) | Cooling rate to 660° C. (° C./Hr) | Cementite average aspect ratio after spheroidization heat treatment | Tensile strength after spheroidization heat treatment (MPa) |
|---|---|---|---|---|---|
| Comparative example 1 | 750 | 10 | 30 | 8.5 | 581 |
| Comparative example 2 | 740 | 11 | 20 | 6.2 | 612 |
| Comparative example 3 | 700 | 12 | 15 | 7.5 | 595 |
| Comparative example 4 | 745 | 14 | 25 | 5.5 | 643 |
| Inventive example 1 | 750 | 13 | 15 | 2 | 512 |
| Inventive example 2 | 745 | 12 | 17 | 2.1 | 520 |

TABLE 4-continued

| Classification | Heating temperature (° C.) | Heating time (Hr) | Cooling rate to 660° C. (° C./Hr) | Cementite average aspect ratio after spheroidization heat treatment | Tensile strength after spheroidization heat treatment (MPa) |
|---|---|---|---|---|---|
| Inventive example 3 | 755 | 13 | 10 | 1.5 | 502 |
| Inventive example 4 | 750 | 15 | 13 | 1.4 | 508 |
| Inventive example 5 | 760 | 14 | 15 | 1.3 | 493 |

As indicated in Tables 1 to 4 above, in Inventive Examples 1 to 5 satisfying the alloy composition and manufacturing conditions suggested in the present disclosure, the microstructure type and the fraction of the present disclosure and also fine grains were secured, such that, with only the spheroidization heat treatment performed once, the average aspect ratio of cementite was less than 2.5.

However, in Comparative Examples 1 to 4 which did not satisfy the alloy composition or manufacturing conditions suggested in the present disclosure, it is indicated that the microstructure type and the fraction of the present disclosure were not satisfied, or fine grains were not secured, such that the cementite average aspect ratio was relatively high when the spheroidization heat treatment was performed once, and accordingly, to be applied to a final product, additional spheroidization heat treatment may be necessary.

FIG. 1 is an image of a microstructure before finishing hot-rolling in comparative example 1, obtained using an optical microscope. FIG. 2 is an image of a microstructure before finishing hot-rolling in inventive example 1, obtained using an optical microscope. As indicated in FIGS. 1 and 2, the AGS before the finishing hot-rolling was relatively fine in Inventive Example 1 as compared to Comparative Example 1.

FIG. 3 is an image of a microstructure after rolling and cooling in comparative example 1, obtained using an SEM. FIG. 4 is an image of a microstructure after rolling and cooling in inventive example 1, obtained using an SEM. As indicated in FIGS. 3 and 4, the microstructure of Inventive Example 1 was refined after rolling and cooling, and the cementite was segmented, as compared to Comparative Example 1.

FIG. 5 is an image of a microstructure after spheroidizing heat treatment in comparative example 1, obtained using an SEM. FIG. 6 is an image of a microstructure after spheroidizing heat treatment in inventive example 1, obtained using an SEM. As indicated in FIGS. 5 and 6, the microstructure of Inventive Example 1 was more spheroidized after the spheroidizing heat treatment as compared to Comparative Example 1.

The invention claimed is:

1. A steel wire rod enabling omission of softening heat treatment, the steel wire rod comprising:

by weight %, 0.2-0.45% of C, 0.02-0.4% of Si, 0.3-1.5% of Mn, 0.01-1.5% of Cr, 0.02-0.05% of Al, 0.01-0.5% of Mo, 0.01% or less of N, and a balance Fe and other inevitable impurities, wherein a microstructure has a main phase of a composite structure of proeutectoid ferrite+pearlite, and includes 10 area % or less of one or more of bainite or martensite, and wherein an average colony size of pearlite is 5 μm or less.

2. The steel wire rod of claim 1, wherein a fraction of proeutectoid ferrite is 80% or more of an equilibrium phase.

3. The steel wire rod of claim 1, wherein, in the steel wire rod, an average grain size of proeutectoid ferrite is 7 μm or less.

4. The steel wire rod of claim 1, wherein, in the steel wire rod, an average size of a long axis of cementite in pearlite colony is 5 μm or less.

5. The steel wire rod of claim 1, wherein the steel wire rod has tensile strength of 800 MPa or less.

6. The steel wire rod of claim 1, wherein, in the steel wire rod, an average aspect ratio of cementite is 2.5 or less after a spheroidization heat treatment is performed once.

7. The steel wire rod of claim 1, wherein the steel wire rod has tensile strength of 540 MPa or less after a spheroidization heat treatment is performed once.

* * * * *